US011428028B2

(12) United States Patent
Gell

(10) Patent No.: US 11,428,028 B2
(45) Date of Patent: Aug. 30, 2022

(54) ELECTRONIC STRIKE PLATE FOR DOOR ASSEMBLY

(71) Applicant: Jason Gell, Brookline, MA (US)

(72) Inventor: Jason Gell, Brookline, MA (US)

( * ) Notice: Subject to any disclaimer, the term of this patent is extended or adjusted under 35 U.S.C. 154(b) by 0 days.

(21) Appl. No.: 17/346,672

(22) Filed: Jun. 14, 2021

(65) Prior Publication Data

US 2021/0388640 A1 Dec. 16, 2021

Related U.S. Application Data

(60) Provisional application No. 63/038,966, filed on Jun. 15, 2020.

(51) Int. Cl.
*E05B 47/06* (2006.01)

(52) U.S. Cl.
CPC ..... *E05B 47/0696* (2013.01)

(58) Field of Classification Search
CPC ..... E05B 47/00; E05B 47/0696; E05B 47/02; E05B 47/026; E05B 47/0002; E05B 47/0003; E05B 47/0004; E05B 47/0006; E05B 47/0046; E05B 47/06; E05B 47/0603; E05B 63/248; E05B 2047/002; E05B 2047/0022; E05B 2047/0028; E05B 2047/0036; E05B 2047/0037; E05B 2047/0048; E05B 2047/005; E05B 2047/0054; E05B 2047/0056; E05B 2047/0058; E05B 2047/0061; E05B 2047/0067; E05B 2047/0068; E05B 2047/0069; E05B 2047/0074
USPC ..... 70/277
See application file for complete search history.

(56) References Cited

U.S. PATENT DOCUMENTS 3,998,483 A * 12/1976 Yan ..... E05B 63/248 292/254
5,474,342 A * 12/1995 Smith ..... E05B 63/248 292/254
5,729,198 A * 3/1998 Gorman ..... E05B 63/248 340/539.1
5,987,818 A * 11/1999 Dabideen ..... E05B 63/22 49/280

OTHER PUBLICATIONS

International Search Report and Written Opinion for International Appl. No. PCT/US202 1/037202, dated Sep. 16, 2021, 8 pages.

* cited by examiner

*Primary Examiner* — Nathan Cumar
(74) *Attorney, Agent, or Firm* — Fish & Richardson P.C.

(57) ABSTRACT

An apparatus for interacting with a latch of a door includes a contact component configured to make physical contact with the latch, an electrically-powered module, and a housing. The electrically-powered module is configured to move the contact component such that the contact component pushes the latch out of a bore of a door frame and into the door. The housing contains the electrically-powered module and the contact component, and is configured to fit within the bore of the door frame. The apparatus can also include a mounting plate attached to the housing, the mounting plate configured to mount the apparatus to the door frame such that the housing is disposed within the bore of the door frame.

22 Claims, 7 Drawing Sheets

ELECTRONIC STRIKE PLATE FOR DOOR ASSEMBLY

CROSS REFERENCE TO RELATED APPLICATIONS

This application claims the benefit under 35 U.S.C. § 119(e) of U.S. Application No. 63/038,966, titled "ELECTRONIC STRIKE PLATE FOR DOOR ASSEMBLY," filed Jun. 15, 2020, the entire contents of which are incorporated herein by reference.

BACKGROUND

This description relates to door assemblies that can be operated, at least in part, by electronic components. A door assembly may include a door and a corresponding door frame configured to receive the door. For example, in some cases, the door may be mounted to a doorjamb of the door frame (e.g., using mounting hinges), and may be configured to swing about a hinge axis or pivot axis extending vertically from a floor's surface.

In some door assemblies, the door frame includes a bore (sometimes referred to as a "latch bore"), configured to receive a door latch included within the door. Generally, in door assemblies that include a door latch (e.g., a spring-driven door latch), a door is closed when the door latch is positioned within the bore. When the door latch is not positioned within the bore, the door is able to open (e.g., by swinging about a hinge axis or a pivot axis), provided there are no further restrictions on the door's movement (e.g., a deadbolt, a lock, an object blocking the door, etc.).

SUMMARY

The apparatus, systems, and techniques described herein can improve the ease of installment, security, hygiene, and user experience of door assemblies. An electronic strike plate is configured to fit within a standard latch bore and can push a door latch out of the latch bore and into the door, allowing the door to be opened.

In one aspect, an apparatus for interacting with a latch of a door includes a contact component configured to make physical contact with the latch, an electrically-powered module configured to move the contact component such that the contact component pushes the latch out of a bore of a door frame and into the door, and a housing containing the electrically-powered module and the contact component, the housing configured to fit within the bore of the door frame.

Implementations may include one or more of the following features. The apparatus may further include a mounting plate attached to the housing, the mounting plate configured to mount the apparatus such that the housing is disposed within the bore of the door frame. The mounting plate may include a strike edge configured to make contact with the latch of the door when the door is closing, the strike edge causing the latch to be pushed into the door as the door is closing. The apparatus may further include a power source. The power source may include at least one of a battery, a DC electric power source, an AC electric power source, a trickle charger and battery combination, an RFID power source, and an electromagnetic field. The power source may be contained within the housing. The power source may be disposed outside of the housing. The electrically-powered module may include an electric motor. Rotation of the electric motor in a first direction may drive the contact component towards the door, and rotation of the electric motor in a second direction may drive the contact component away from the door. The electrically-powered module may further include a gear train assembly driven by the electric motor. The electrically-powered module may further include a ribbon that is configured to wrap around a spool driven by the gear train assembly. The electrically-powered module may include an electromagnet. Energization of the electromagnet may drive the contact component towards the door and into a first position, and wherein de-energization of the electromagnet may cause the contact component to return to a second position, the second position being farther from the door than the first position. The apparatus may further include a controller, and wherein the electrically-powered module may be configured to move the contact component in response to receiving a control signal from the controller. The control signal may be received from a user of the apparatus via at least one of RFID, Bluetooth, WIFI, radio, infrared, and other wireless technology. The control signal may be generated in response to data collected from one or more sensors. The contact component may include a beveled edge configured to contact the latch of the door at an angle between 0 degrees and 90 degrees. The electrically-powered module may be further configured to move the contact component away from the door such that a space is created that allows the latch of the door to fit within the bore of the door frame. The electrically-powered module may be configured to move the contact component away from the door after a fixed time delay subsequent to moving the contact component such that the contact component pushes the latch out of the bore of the door frame. The housing may be an enclosed housing, a framed housing, etc.

In another aspect, a system includes, a door comprising a latch, a door frame comprising a bore, the bore configured to receive the latch, and an apparatus configured to interact with the latch, the apparatus mounted to the door frame. The apparatus includes a contact component configured to make physical contact with the latch, an electrically-powered module configured to move the contact component such that the contact component pushes the latch out of the bore of the door frame and into the door, and a housing containing the electrically-powered module and the contact component, the housing configured to fit within the bore of the door frame.

These and other aspects, features, and various combinations may be expressed as apparatuses, systems, methods, means for performing functions, etc.

Various implementations described herein may provide one or more of the following advantages. An electronic strike plate may enable users to open a door without using their hands, improving the hygiene of operating a door assembly. The electronic strike plate can be controlled remotely, allowing for a door assembly to be operated when a user is not present (e.g., a remote user enabling a delivery worker to open the door to securely drop off a package). Since the electronic strike plate is configured to fit within a standard latch bore, it can be installed with no or limited modification to the doorjamb of the door frame. The electronic strike plate can be implemented with any standard spring-driven door latch without regard to the original manufacturer. Unlike existing electronic strike plates, all of the moving parts of the electronic strike plate can be contained within the door frame so that they are not visible when the door is closed. Other features and advantages will be apparent from the description and the claims.

DETAILED DESCRIPTION

Figure 1:
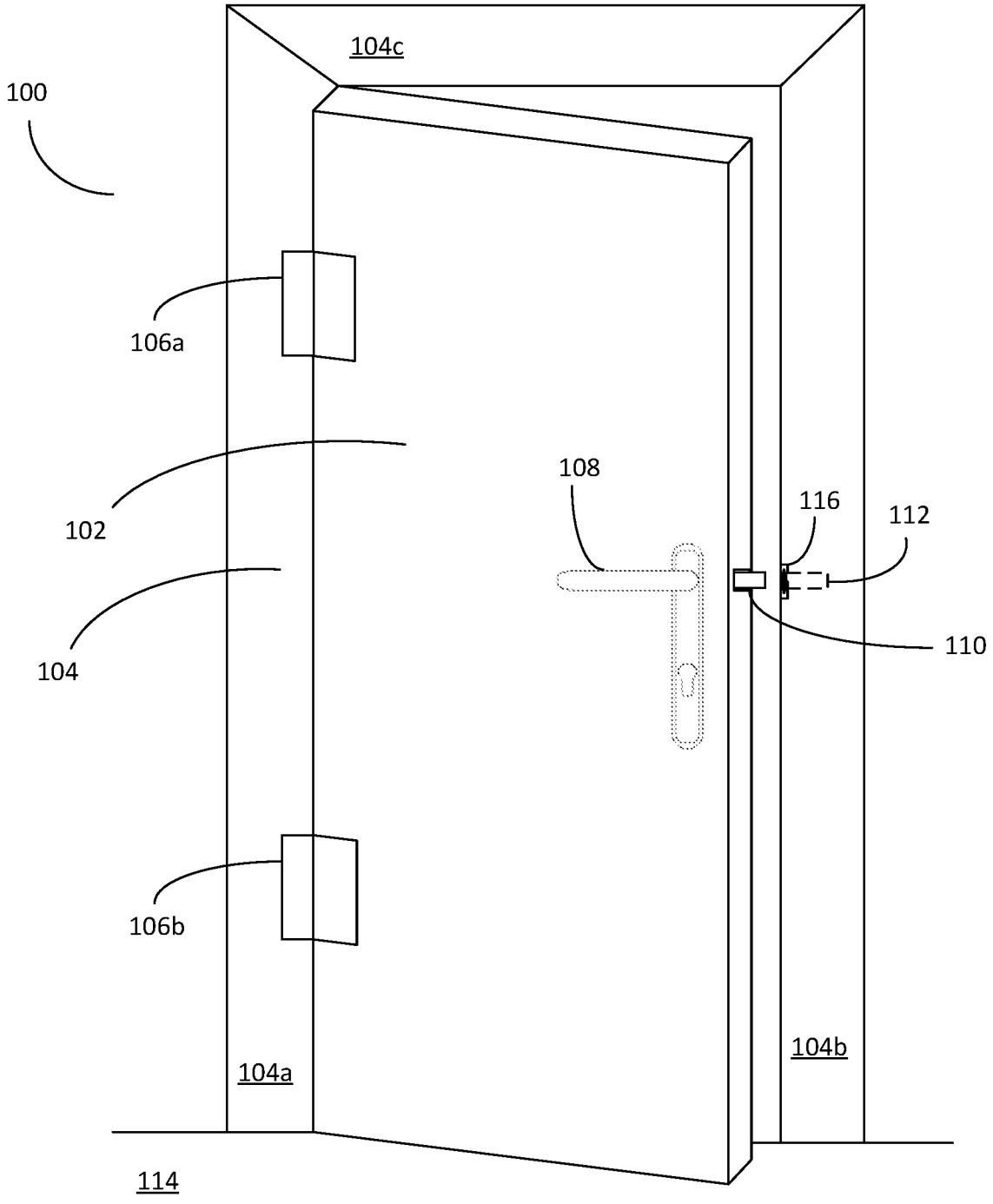
FIG. 1 is a front view of a door assembly.

FIG. 1 depicts an example door assembly 100. The door assembly 100 includes a door 102 and a corresponding door frame 104. The door frame 104 includes doorjambs 104*a*, 104*b*, which are oriented substantially perpendicular to the floor 114 and define the width of the door assembly 100. The door frame 104 also includes a lintel (sometimes referred to as a head) 104*c*, which connects the doorjambs 104*a*, 104*b* along a top portion of the door frame 104. The door frame 104 is configured to receive the door 102. For example, the door 102 may be mounted to the door frame 104 using mounting hinges 106*a*, 106*b* such that the door 102 is able to swing about a hinge axis or pivot axis extending vertically from the floor 114. The door 102 is considered closed when it is substantially aligned with the plane of the door frame 104. The door 102 is considered open when the door 102 is not aligned with this plane. In some cases, if the door 102 is open, the door assembly 100 can be considered open. Likewise, if the door 102 is closed, the door assembly 100 can be considered closed. The door assembly 100 is exemplary in nature and is not to be considered limiting. For example door assembly 100 may include various additional components including deadbolt locks, dampers, multiple bores, etc. Other implementations of door assemblies will be readily apparent to a person of ordinary skill in the art.

The door 102 may include a handle 108 and a latch 110. A doorjamb 104*b* of the door frame 104 may include a bore 112 (sometimes referred to as a latch bore) extending into the doorjamb 104*b* and configured to receive the latch 110. In some cases, the latch 110, the bore 112, and a mechanism for controlling the latch 110 (which may include the handle 108) can be referred to as a latch assembly. In some cases, the latch assembly may also include a strike plate 116, which is described in further detail herein.

Figure 2:
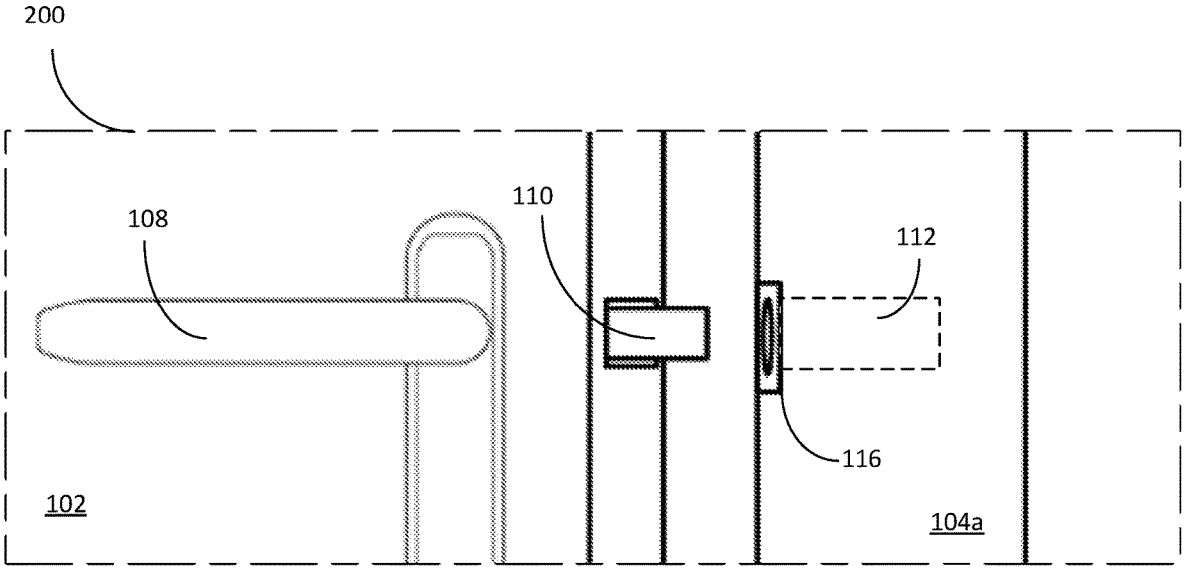
FIG. 2 is a close-up view of the door assembly of FIG. 1.

FIG. 2 depicts a close-up view 200 of the door assembly 100, showing the latch assembly in greater detail. In the depicted implementation of the latch assembly, the handle 108 can be used to control the latch 110. For example, rotation of the handle 108 in a first direction (e.g., counter-clockwise) can cause the latch 110 to withdraw inside the door 102, and rotation of the handle in a second direction (e.g., clockwise) can cause the latch 110 to protrude outwardly from the door 102. In general, we use the term "inside the door" and "outside the door" to refer to the relative position of the latch 110 within the body of the door 102. For example, when the latch 110 is positioned completely "inside" the door, it is not visible at all from a front view of the door 102. As the latch 110 protrudes further "outside" the door, a greater portion of the latch 110 can be seen from a front view of the door 102.

In some cases, the latch assembly may be a spring-driven latch assembly. In a spring-driven latch assembly, the mechanism for controlling the latch 110 includes a spring for biasing the latch toward a particular state. For example, a spring-driven latch assembly can include a spring that biases the latch 110 such that in the absence of any external force applied by a user, the latch 110 is pushed outside the door 102. A user may rotate the handle 108 to overcome the spring force and withdraw the latch 110 inside the door 102. However, once the user releases the handle 108, the latch 110 is automatically pushed outside the door 102 by the spring. While an example mechanism including a handle 108 is described, various other mechanisms such as key-operated mechanisms, sliding latch mechanisms, door knobs, etc. may be used to control the position of the latch 110.

The latch assembly includes a bore 112 that is configured to receive the latch 110 when the door 102 is in a closed position. In a spring-driven latch assembly, the latch 110 may be configured to automatically position itself within the bore 112 as the door 102 is closing. Once the door 102 is closed, the doorjamb 104*a* restricts the motion of the door 102, and the door 102 can only be opened by withdrawing the latch 110 inside the door 102 (e.g., by rotating the handle 108). Upon being withdrawn into the door 102, the latch 110 is cleared from the bore 112, allowing the door 102 to be freely opened.

In some cases, a strike plate 116 is mounted to the doorjamb 104*a* such that a receiving hole of the strike plate 116 is aligned with an opening of the bore 112. The strike plate 116 can protect the doorjamb 104*a* against friction from the latch 110 and can increase security in cases where the doorjamb 104*a* is made of a softer material than the strike plate 116. For example, in some cases, the doorjamb 104*a* may be made of wood while the strike plate is made of metal. In some cases, the lateral edges of the strike plate 116 may wrap around the doorjamb 104*a* such that the doorjamb 104*a* is shielded from making direct contact with the latch 110 as the door 102 is opening or closing. In some cases, the strike plate 116 can include a strike edge that creates contact with the latch 110 when the door is closing and causes the latch 110 to be pushed into the door 110. The strike edge may be positioned at an angle between 0 and 90 degrees from a faceplate of the strike plate 116 and may be between 1.5 inches and 7 inches long.

While traditional strike plates include only mechanical components, in some cases, a strike plate with electronic components (herein referred to as an "electronic strike plate") may provide various advantages. For example, an electronic strike plate may include an actuation module that can push the latch 110 out of the bore 112 and into the door 102, allowing the door 102 to be freely opened. This can enable users to open the door 102 without touching the handle 108 and without using their hands, which can improve hygiene and ease of operation (e.g., if the user is holding an object with both hands). In some cases, an electronic strike plate can be controlled remotely, allowing the user to withdraw the latch 110 into the door 102 even in cases where the user is unable to physically reach the door 102.

Figure 3A:
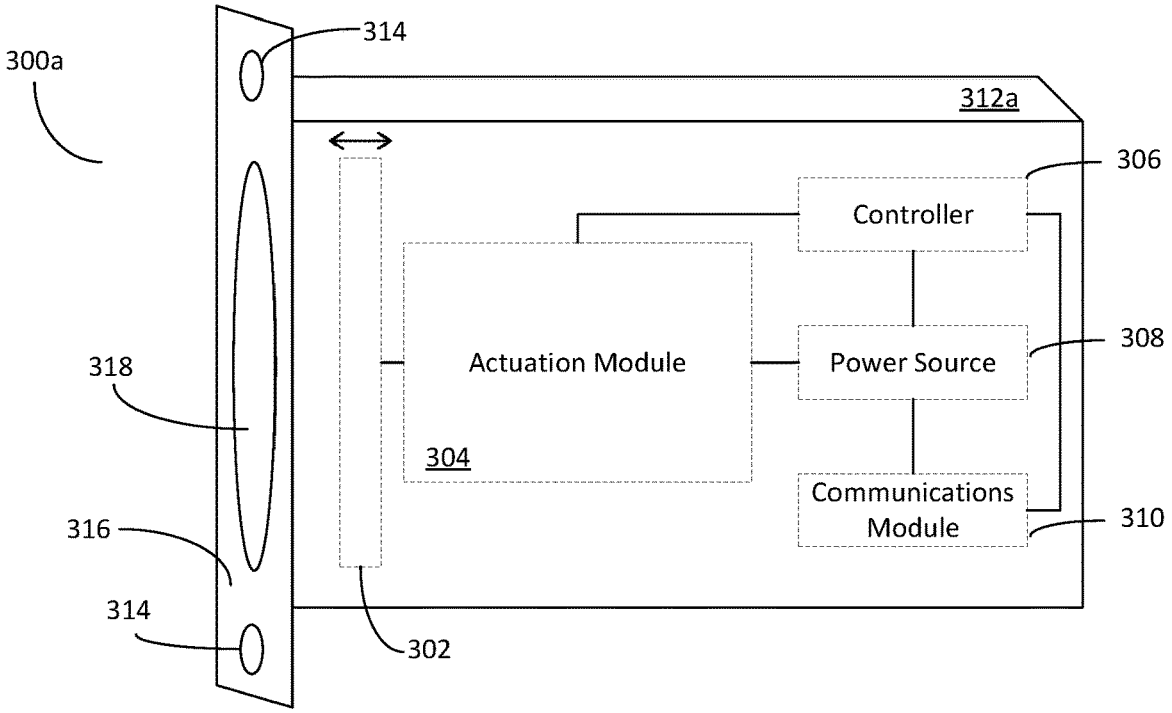
FIG. 3A is a block diagram of an electronic strike plate with an enclosed housing.

FIG. 3A depicts an electronic strike plate 300*a* with an enclosed housing 312*a*. Similar to strike plate 116, the electronic strike plate 300*a* includes a faceplate 316 that is configured to be mounted to a doorjamb (e.g., doorjamb 104*b*) via mounting holes 314. The face plate 316 may be between 1.5 inches and 7 inches tall and may be attached to a strike edge as previously described for strike plate 116. Both the face plate 316 and the strike edge may be made of metal, plastic, composite, ceramic, or a blend of materials.

The electronic strike 300*a* plate also includes a receiving hole 318 configured to receive a latch (e.g., latch 110) when a door (e.g., door 102) is in a closed position. The electronic strike plate 300*a* includes a housing 312*a*, which is attached to the faceplate 316 and contains one or more components of the electronic strike plate 300*a*. In some cases, the housing 312*a* is an enclosed housing. In an enclosed housing, the components contained by the housing 312*a* are not visible from outside of the electronic strike plate 300*a* (except, in some cases, through the receiving hole 318). In some implementations, the housing 312*a* is sized to fit within a standard latch bore (e.g., bore 112) with little to no modification to the doorjamb (e.g., doorjamb 104*b*). In some cases, the housing 312*a* may be formed as a single body with the faceplate 316. In some cases, the housing 312*a* may be formed separately from the faceplate 316 and can be configured to attach to any standard strike plate (e.g., strike plate 116). In some implementations, the housing 312*a* may contain tracks and/or mounting points to attach and guide the motion of the various components of the electronic strike plate 300*a*, further described herein. In some cases, the housing 312*a* may be made out of plastic, composite, ceramic, metal, or a combination of materials.

Within the housing 312*a*, the electronic strike plate 300*a* may include various components including a contact plate 302, an actuation module 304, a controller 306, a power source 308, and a communications module 310. A contact plate 302 is a component configured to make physical contact with the latch 110 in order to push the latch 110 out of the electronic strike plate 300*a* and into the door 102. In some implementations, the contact plate 302 can be between 0 inches and 3 inches tall and between 0 inches and 3 inches wide. The contact plate 302 may have a bevel or an angle of contact with the latch 110 of between 0 and 90 degrees. In some cases, the contact plate 302 is not necessarily a distinct component, but can be incorporated as part of another component (e.g., a component of the actuator module 304). In some cases, the contact plate 302 may be made of metal, plastic, composite, ceramic, or a blend of materials.

Motion of the contact plate 302 is facilitated by the actuation module 304, which includes a mechanism for pushing the contact plate 302 toward the receiving hole 318 or retracting the contact plate 302 away from the receiving hole 318. Example actuation modules 304 and corresponding mechanisms are described in further detail in relation to FIGS. 4A, 4B, 5A, and 5B.

The actuation module 304 is powered by a power source 308. The power source 308 may be any source of power including batteries, DC electric power sources, AC electric power sources, a trickle charge and battery combination, and wireless power sources such as RFID or other electromagnetic fields. In some implementations, the power source 308 is included within the housing 312*a*. In other implementations, the power source 308 can be disposed external to the housing 312*a*. For example, the power source 308 may be an external battery shared between the electronic strike plate 300*a* and another electronic component of the door assembly 100 (e.g., an electronic deadbolt lock).

In addition to powering the actuation module 304, the power source 308 provides power to the controller 306 and the communications module 310. The communications module 310 is configured to provide communication between the electronic strike plate 300*a* and other devices (e.g., a personal device of the user, one or more sensors, etc.). The communication module 310 may be wired (e.g., Ethernet) or wireless (e.g., employ a wireless communication protocol such as IEEE 802.11, Bluetooth, Bluetooth Low Energy, or other local area network (LAN) or personal area network (PAN) protocols). In some cases, communication enabled by the communication module 310 can be unidirectional. For example, the communication module can be configured only to receive information from other devices (e.g., a remote control signal from a user's phone, input from one or more sensors, etc.). In some cases, communication enabled by the communication module 310 can be bidirectional. For example, in addition to receiving information from other devices, the communication module 310 may be configured to transmit information to other devices (e.g., transmit a confirmation or error message to a user's phone, transmit control instructions to one or more sensors, etc.)

The communications modules passes on received information to the controller 306. For example, the received information may include a control signal received from a user's personal device (e.g., a laptop, a phone, an IoT-connected device, etc.). In some implementations, the received information may include input signals received from one or more sensors (e.g., an audio signal recorded by a microphone sensor; an image or video captured by a camera sensor; an input signal captured by a distance sensor, weight sensor, etc.). The controller 306 then processes the received information to determine how to control the actuation module 304. For example, if the controller 306 receives a control signal from a user's phone to open the door 102, the controller 306 may send a control signal to the actuation module 304, causing it to push the contact plate 302 toward the receiving hole 318. Similarly, if the controller receives input signals from one or more sensors that indicates the presence of a trusted user (e.g., a recognized voice command, a captured image of a trusted user's face, etc.), the controller may send a control signal to the actuation module 304, causing it to push the contact plate 302 toward the receiving hole 318. In some cases, if the received information is indicative of an unrecognized user, the controller 306 can cause the actuation module 304 to keep the contact plate 302 retracted from the receiving hole 318. The controller 306 may also cause the communications module 310 to send an alert signal to a personal device of a trusted user.

In some implementations, after sending a control signal that causes the actuation module 304 to push the contact plate 302 toward the receiving hole 318, the controller 306 can automatically cause the actuation module 304 to retract the contact plate 302 away from the receiving hole 318 after a fixed delay ranging from 0.5 seconds to 10 seconds (e.g., 0.5 s, 1 s, 2 s, 5 s, 10 s, etc.). In some cases, the duration of the fixed delay can be set by a user (e.g., a trusted user) of the electronic strike plate 300*a*.

In some implementations, the controller 306 locally processes all information received from the communication module 310 to determine how to control the actuation module 304. In some implementations, the data can be processed partially or entirely in one or more external devices such as a personal device of the user and/or a cloud-based computing system.

Figure 3B:
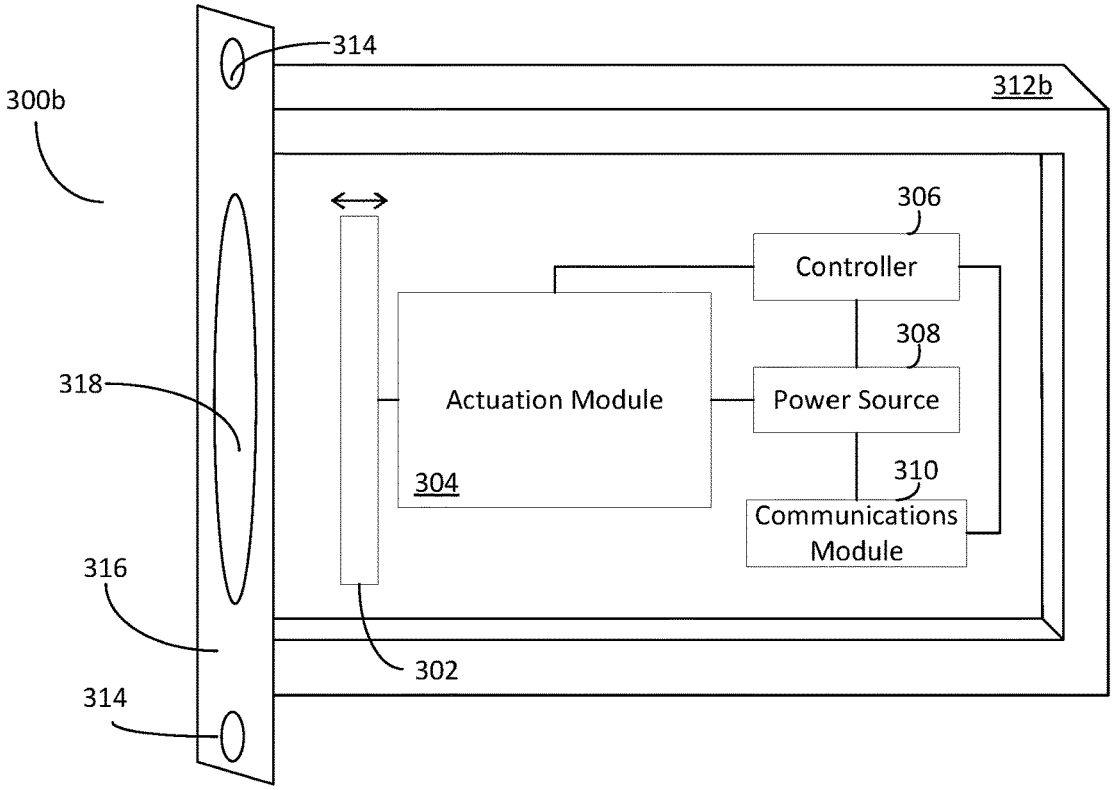
FIG. 3B is a block diagram of an electronic strike plate with a framed housing.

FIG. 3B depicts an example implementation of an electronic strike plate 300*b* with a framed housing 312*b*. Similar features of electronic strike plate 300*a* and electronic strike plate 300*b* are labeled similarly. However, unlike the enclosed housing 312*a* of electronic strike plate 300*a*, the framed housing 312*b* of electronic strike plate 300*b* allows for its components to be visible from outside of the electronic strike plate 300*b*. This may provide advantages such as reduced material costs and easier maintenance (e.g., easier access to the power source 308). For both electronic strike plate 300*a* and electronic strike plate 300*b*, all of the moving components can be shielded by the doorjamb 104*b* when the housing 312*a*, 312*b* is inserted into the latch bore 112. In such implementations, no moving components are visible to a user of the door assembly 100 when the door 102 is closed. In some implementations, the housing of an electronic strike plate may be a combination of partially enclosed and partially framed.

Figure 4A:
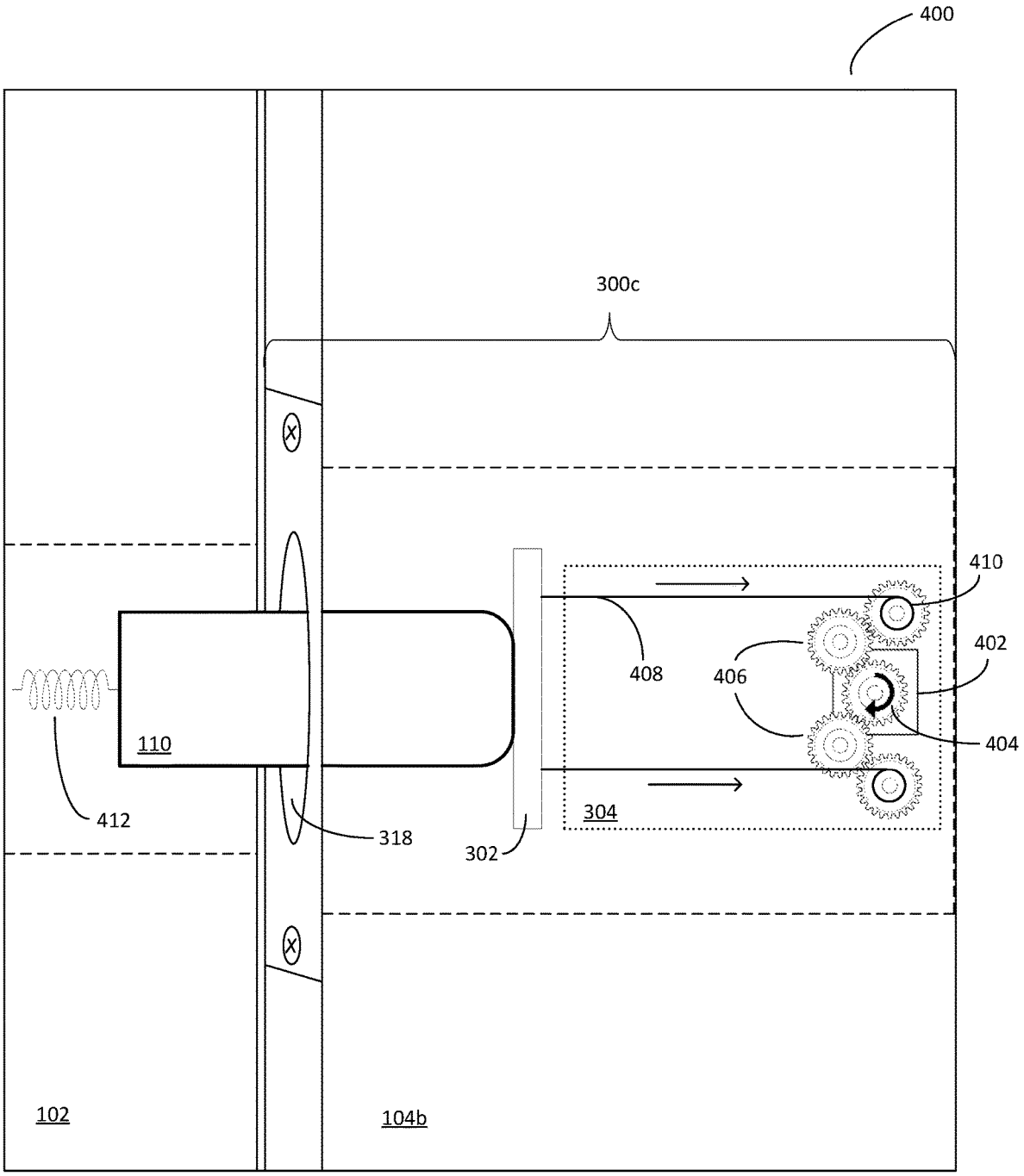
FIG. 4A is a schematic of a closed door assembly with a first exemplary actuation module.
Figure 4B:
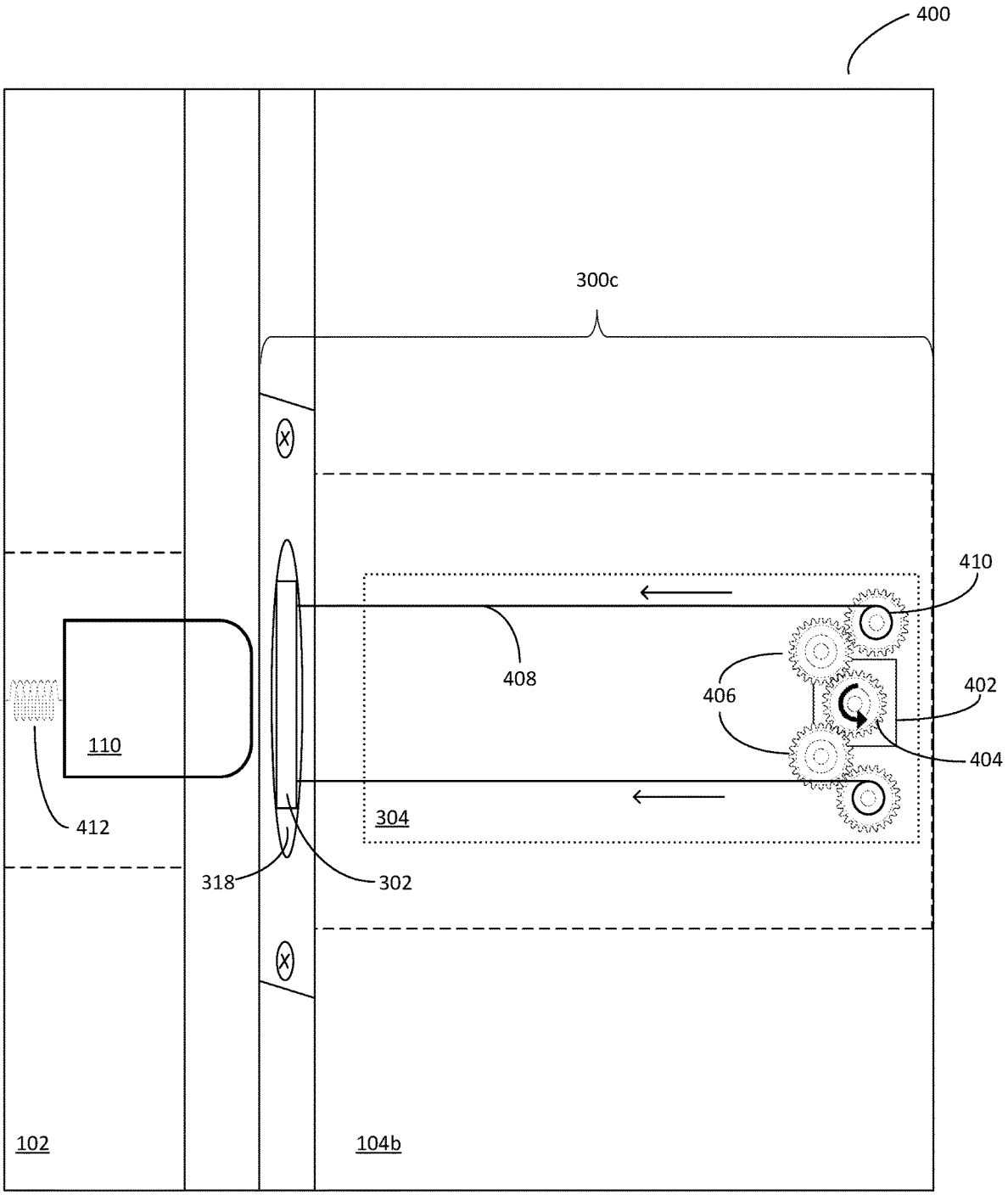
FIG. 4B is a schematic of an open door assembly with the first exemplary actuation module.

FIG. 4A is a schematic of an example door assembly 400 in a closed configuration. FIG. 4B shows the same door assembly 400 in an open configuration. Referring to the door assembly 400 of FIG. 4A, the door 102 is aligned with plane of the door frame 104*b* and is considered closed. The door 102 includes a latch 110 that is driven by a spring 412. An electronic strike plate 300*c* is mounted to the doorjamb 104*b* (e.g., by inserting the electronic strike plate 300*c* into a latch bore of the doorjamb 104*b*). In the closed configuration of the door assembly 400, the latch 110 is driven by the spring 412 out of the door 102 and into the electronic strike plate 300*c* through the receiving hole 318. In this configuration, the presence of the latch 110 prevents the door 102 from being opened. The spring 412 drives the latch 110 to make physical contact with the contact plate 302. Hence, movement of the contact plate 302, as facilitated by the actuation module 304, can control the position of the latch 110.

In some implementations, the actuation module 304 can include a motor 402, a drive gear 404, a gear train 406, and metal ribbons 408. The motor 402 can be an electric motor and can receive power from a power source (e.g., power source 308). Rotation of a shaft of the motor 402 in a first direction (e.g. in a clockwise direction) rotates the drive gear 402, which in turn drives the gear train 406. The gear train 406 can be driven such that one or more metal ribbons 408 are wound up around one or more spools 410, causing the contact plate 302 to withdraw further into the electronic strike plate 300*c*. The withdrawal of the contact plate 302 further into the electronic strike plate 300*c* allows the spring-driven latch 110 to penetrate further into the electronic strike plate 300*c*.

Referring to FIG. 4B, rotation of the shaft of the motor 402 in a second direction (e.g., a counterclockwise direction) can cause the metal ribbons 408 to unwind from the spools 410, and push the contact plate 302 toward the receiving hole 318 of the electronic strike plate 300*c*. As the contact plate 302 is moved toward the receiving hole 318, the contact plate pushes the latch 110 out of the electronic strike plate 300*c* and into the door 102. When the latch 110 is fully pushed out of the electronic strike plate 300*c*, the door 102 is able to freely open. This is depicted in FIG. 4B by the widened gap between the door 102 and the door frame 104*b*.

Figure 5A:
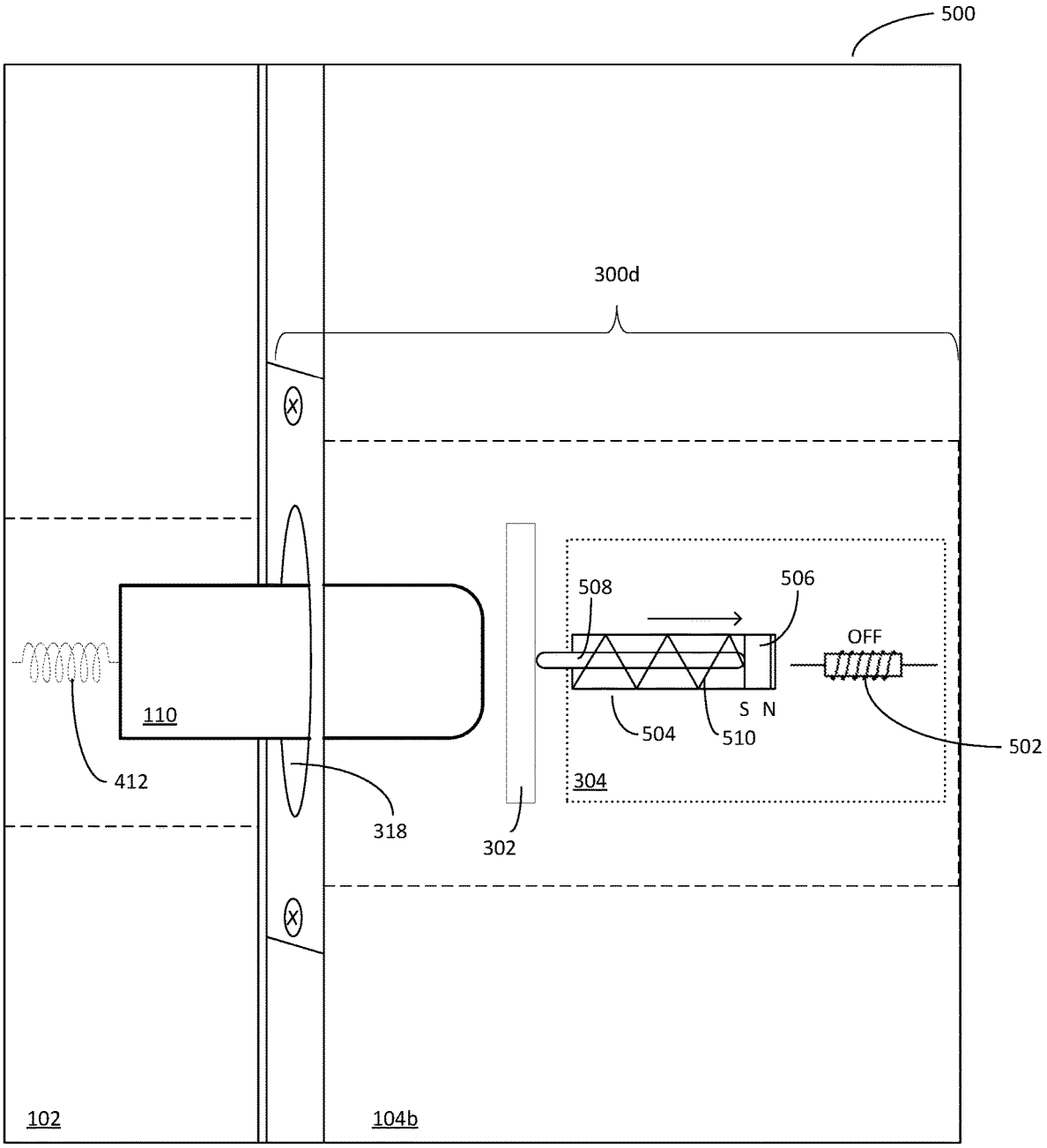
FIG. 5A is a schematic of a closed door assembly with a second exemplary actuation module.
Figure 5B:
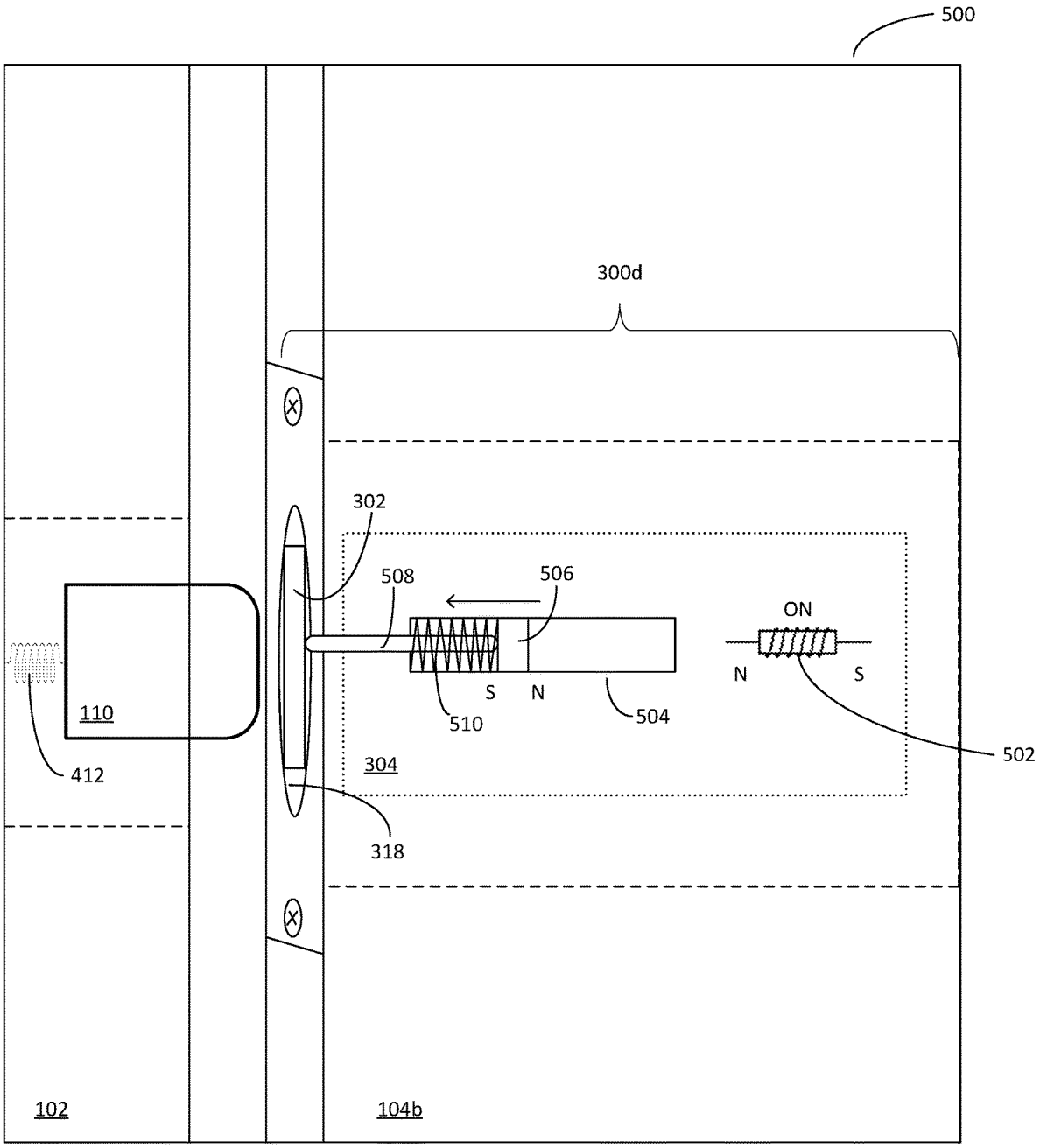
FIG. 5B is a schematic of an open door assembly with the second exemplary actuation module.

FIG. 5A shows another implementation of a door assembly 500 in a closed configuration. FIG. 5B shows the same door assembly 500 in an open configuration. Referring to FIG. 5A, in some implementations, the actuation module 304 of the electronic strike plate 300*d* can include an electromagnet 502 and a piston 504. The piston 504 can include a magnetic head 506 connected to a rod 508. In some cases, the rod 508 is connected directly or indirectly to the contact plate 302 such that movement of the rod 508 drives movement of the contact plate 302. The piston 504 can also include a spring 510 that biases the head 506 and the rod 508 toward a first position (e.g., a withdrawn position within the electronic strike plate 300*d*).

The electromagnet 502 can be configured to receive power from a power source (e.g., power source 308), which may cause the electromagnet 502 to generate a magnetic field. However, when no power is supplied to the electromagnet 502, the electromagnet 502 is turned off and does not generate a magnetic field. In some cases, when the electromagnet 502 is turned off, the head 506 and the rod 508 of the piston 504 are driven by the spring 510 to a withdrawn position within the electronic strike plate 300*d*. Consequently, the contact plate 302 may be retracted away from the receiving hole 318, allowing the latch 110 to enter the electronic strike plate 300*d*. Note that it is not required that the latch 110 always be in contact with the contact plate 302. As shown in FIG. 5A, in some cases, the latch 110 can be driven by spring 412 up to a maximum depth within the electronic strike plate 300*d* such that any further withdrawal of the contact plate 302 does not affect the position of the latch 110.

Referring now to FIG. 5B, when the electromagnet 502 is turned on (e.g. by receiving power from the power source 308), the electromagnet 502 can generate a magnetic field. The magnetic field may interact with the magnetic head 506 of the piston 504, driving the head 506 and the rod 508 toward the receiving hole 318. Consequently, the contact plate 302 can be pushed toward the receiving hole 318, displacing the latch 110 from its position within the electronic strike plate 300*d*. When the latch 110 is fully pushed out of the electronic strike plate 300*c*, the door 102 is able to freely open. This is depicted in FIG. 5B by the widened gap between the door 102 and the door frame 104*b*.

Other mechanisms for driving the motion of the contact plate 302 will be readily apparent to a person of ordinary skill in the art. For example, any assembly driven by an electric motor can be used to apply mechanical force to move the contact plate 302. In some cases, mechanisms that include an electromagnet (e.g., electromagnet 502) may not require a piston (e.g., piston 504). For example, the contact plate 302 can itself be made of a magnetic material or can be attached to a magnet. In other examples, the latch 110 can be made of a magnetic material or can be attached to a magnet. In such implementations a contact plate 302 may not be required since the latch 110 can be moved without any physical contact. While example implementations of the actuation module 304 are provided including motors or electromagnets, these are exemplary and not intended to be limiting.

In some implementations, a latch assembly may include a dead pin (sometimes referred to as a deadlocking plunger). In some cases, latch assemblies that include a dead pin may be referred to as a deadlock latch assembly or dead latch assembly. Dead pins are well-known to those of ordinary skill in the art and provide additional security to the latch assembly. When the dead pin is depressed and the latch is fully extended, the latch cannot be retracted into the door. However, when both the dead pin and the latch are fully extended, the dead pin and the latch may simultaneously be retracted into the door. In a proper installation of a deadlock latch assembly, when a door is closed, the dead pin is depressed (e.g., by a faceplate of a strike plate) while the latch is fully extended (e.g., into a receiving hole of the strike plate). This can protect against security breaches such as the use of a credit card or a screwdriver to retract the latch into the door, thereby allowing the door to be opened.

In some implementations, an electronic strike plate (e.g. electronic strike plate 300*a*-300*d*) can be adapted to operate with a deadlock latch assembly. For example, the electronic strike plate may have a gate or dead pin cover that depresses the dead pin when the door is closed, while allowing the latch to fully extend into the receiving hole of the strike plate. In some cases, this may be implemented by a gate or dead pin cover that partially obstructs the receiving hole of the electronic strike plate (e.g., thereby preventing the dead pin from fully extending into the receiving hole). In this closed configuration of the door assembly, the latch is unable to be retracted or pushed into the door (e.g., by the contact plate 302) until the dead pin is fully extended.

In order to open the door, the gate or dead pin cover can be opened, allowing the dead pin to fully extend into the receiving hole of the electronic strike plate. Once the dead pin is fully extended, a contact plate (e.g. contact plate 302) of the electronic strike plate can push both the dead pin and the latch toward the receiving hole and into the door (e.g., using any of the mechanisms previously described), thereby allowing the door to be opened. In some cases, opening and closing of the gate or dead pin cover may be controlled by the same controller and power source as the actuation module (e.g., actuation module 304) of the electronic strike plate. Alternatively, a separate controller and/or a separate power source may be used. In some implementations, the movement of the actuation module or contact plate itself may cause the gate or dead pin cover to be opened or closed without the need of any additional controllers or power sources.

Various mechanisms for opening and closing the gate or dead pin cover will be readily apparent to a person of ordinary skill in the art. For example, one implementation may include a dead pin cover that is configured to slide back and forth in order to partially obstruct or clear the receiving hole of the electronic strike plate. Other implementations may include a hinged dead pin cover that rotates about a hinge axis in order to partially obstruct or clear the receiving hole of the electronic strike plate. In some implementations, the gate or dead pin cover may include multiple components (e.g., two halves) that are coordinated to partially obstruct or clear the receiving hole of the electronic strike plate. In some implementations, the gate or dead pin cover may be biased toward a closed position (e.g., by a spring), such that in the absence of an actively applied force to open the gate or dead pin cover, the gate or dead pin cover remains closed.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a standalone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hardwired and/or wireless means such that these electronic components can communicate data with one another. Additionally, sub-components within a given component can be considered to be linked via conventional pathways, which may not necessarily be illustrated.

A number of embodiments have been described. Nevertheless, it will be understood that various modifications can be made without departing from the spirit and scope of the apparatus, systems, and techniques described herein. In addition, other components can be added to, or removed from, the described apparatus and systems. Accordingly, other embodiments are within the scope of the following claims.

What is claimed is:

1. An apparatus for interacting with a latch of a door, the apparatus comprising:

a contact component configured to make physical contact with the latch;

a controller for receiving a wireless control signal;

an electrically-powered module configured to move the contact component in response to receiving a signal from the controller based on the received wireless control signal such that the contact component pushes the latch out of a bore of a door frame and into the door; and a housing containing the electrically-powered module, the controller, and the contact component, the housing configured to fit within the bore of the door frame, wherein the electrically-powered module comprises an electric motor configured to drive the contact component along a linear path of motion.

2. The apparatus of claim 1, further comprising a mounting plate attached to the housing, the mounting plate configured to mount the apparatus such that the housing is disposed within the bore of the door frame.

3. The apparatus of claim 2, wherein the mounting plate comprises a strike edge configured to make contact with the latch of the door when the door is closing, the strike edge causing the latch to be pushed into the door as the door is closing.

4. The apparatus of claim 1, further comprising a power source.

5. The apparatus of claim 4, wherein the power source comprises at least one of a battery, a DC electric power source, an AC electric power source, a trickle charger and battery combination, an RFID power source, and an electromagnetic field.

6. The apparatus of claim 4, wherein the power source is contained within the housing.

7. The apparatus of claim 4, wherein the power source is disposed outside of the housing.

8. The apparatus of claim 1, wherein rotation of the electric motor in a first direction drives the contact component towards the door, and rotation of the electric motor in a second direction drives the contact component away from the door.

9. The apparatus of claim 1, wherein the electrically-powered module further comprises a gear train assembly driven by the electric motor.

10. The apparatus of claim 9, wherein the electrically-powered module further comprises a ribbon that is configured to wrap around a spool driven by the gear train assembly.

11. The apparatus of claim 1, wherein the electrically-powered module comprises an electromagnet.

12. The apparatus of claim 11, wherein energization of the electromagnet drives the contact component towards the door and into a first position, and wherein de-energization of the electromagnet causes the contact component to return to a second position, the second position being farther from the door than the first position.

13. The apparatus of claim 1, wherein the control signal is received from a user of the apparatus via at least one of RFID, Bluetooth, WIFI, radio, infrared, and other wireless technology.

14. The apparatus of claim 1, wherein the control signal is generated in response to data collected from one or more sensors.

15. The apparatus of claim 1, wherein the electrically-powered module is further configured to move the contact component away from the door such that a space is created that allows the latch of the door to fit within the bore of the door frame.

16. The apparatus of claim 15, wherein the electrically-powered module is configured to move the contact component away from the door after a fixed time delay subsequent to moving the contact component such that the contact component pushes the latch out of the bore of the door frame.

17. The apparatus of claim 1, wherein the housing is an enclosed housing.

18. The apparatus of claim 1, wherein the housing is a framed housing.

19. The apparatus of claim 1, wherein the electrically-powered module comprises a gear train assembly to drive the contact component along the linear path of motion.

20. The apparatus of claim 1, wherein the housing includes a cover that allows a dead pin of the door to extend into the housing.

21. The apparatus of claim 20, wherein the electrically-powered module is configured to open the cover in response to receiving the signal from the controller based on the received wireless control signal.

22. A system comprising:

a door comprising a latch;

a door frame comprising a bore, the bore configured to receive the latch; and an apparatus configured to interact with the latch, the apparatus mounted to the door frame, and the apparatus comprising:

a contact component configured to make physical contact with the latch;

a controller for receiving a wireless control signal;

an electrically-powered module configured to move the contact component in response to receiving a signal from the controller based on the received wireless control signal such that the contact component pushes the latch out of the bore of the door frame and into the door; and a housing containing the electrically-powered module, the controller, and the contact component, the housing configured to fit within the bore of the door frame, wherein the electrically-powered module comprises an electric motor configured to drive the contact component along a linear path of motion.

* * * * *